US010833419B1

(12) United States Patent
Rogers

(10) Patent No.: US 10,833,419 B1
(45) Date of Patent: Nov. 10, 2020

(54) WAVEGUIDE FED STRIPLINE ANTENNA

(71) Applicant: The Boeing Company, Chicago, IL (US)

(72) Inventor: John E. Rogers, Owens Cross Roads, AL (US)

(73) Assignee: THE BOEING COMPANY, Chicago, IL (US)

( * ) Notice: Subject to any disclaimer, the term of this patent is extended or adjusted under 35 U.S.C. 154(b) by 26 days.

(21) Appl. No.: 16/421,877

(22) Filed: May 24, 2019

(51) Int. Cl.

| | |
|---|---|
| ***H01Q 13/06*** | (2006.01) |
| ***H01Q 1/48*** | (2006.01) |
| ***H01P 5/08*** | (2006.01) |
| ***H01P 3/08*** | (2006.01) |
| ***H01P 11/00*** | (2006.01) |

(52) U.S. Cl.
CPC ..... *H01Q 13/06* (2013.01); *H01P 3/08* (2013.01); *H01P 5/085* (2013.01); *H01P 11/003* (2013.01); *H01Q 1/48* (2013.01)

(58) Field of Classification Search
CPC .. H01Q 13/06; H01Q 1/48; H01P 3/08; H01P 3/12; H01P 5/085; H01P 11/002; H01P 11/003
See application file for complete search history.

(56) References Cited

PUBLICATIONS

Zhang, G.H., et al., "A circular waveguide antenna using high-impedance ground plane," IEEE 2003.
Li, B., et al., "Study on high gain circular waveguide array antenna with metamaterial structure," 2006.
Rida, A., et al., "Proximity coupled fed antenna arrays on LCP for mm-wave applications," IEEE 2010.
Cheng, Y.J., et al., "W-band large-scale high-gain planar integrated antenna array," IEEE Transactions 2014.

*Primary Examiner* — Daniel D Chang
(74) *Attorney, Agent, or Firm* — Parsons Behle & Latimer

(57) ABSTRACT

An apparatus may include a substrate assembly having a first side and a second side. The apparatus may further include a waveguide antenna element positioned on the first side of the substrate assembly. The apparatus may also include a first reference ground plane positioned on the first side of the substrate assembly. The apparatus may include a microstrip line positioned within the substrate assembly. The apparatus may further include a stripline positioned within the substrate assembly and electrically coupled to the microstrip line, the first reference ground plane overlapping the stripline. The apparatus may also include a second reference ground plane positioned on the second side of the substrate assembly and overlapping both the microstrip line and the stripline. The apparatus may include a stripline antenna element positioned on the second side of the substrate assembly and enclosed by the second reference ground plane.

20 Claims, 8 Drawing Sheets

WAVEGUIDE FED STRIPLINE ANTENNA

FIELD OF THE DISCLOSURE

This disclosure is related to the field of using waveguides to transmit signals to a stripline antenna in a first signal direction and receive signals from a stripline antenna in a second signal direction.

BACKGROUND

Waveguides are used in many radio frequency (RF) applications for low-loss signal propagation. For high frequency applications in particular, waveguides may be preferred over coaxial transmission lines. In some applications, it may be desirable to use waveguides to transition to a stripline antenna. Stripline antennas may be used, individually or in antenna arrays, for various applications, such as high frequency radio communication.

In order for a waveguide to transition to a typical stripline feed for an antenna, multiple adapters are typically required. First, a waveguide-to-coax adapter transitions a waveguide to a coax. Second, a coax-to-microstrip adapter transitions a coax to a microstrip. Finally, the microstrip line may be transitioned to a stripline on an RF board for connection to a stripline antenna. Adapters associated with these transitions can be cost prohibitive at higher frequencies because such adapters are small and may be formed using high precision machining. Also, the size and weight of existing waveguide-to-coax transitions make them non-ideal for many applications.

SUMMARY

In this disclosure, a low-loss waveguide fed stripline antenna apparatus is described. In an embodiment, a low-loss waveguide fed stripline antenna apparatus includes a substrate assembly having a first side and a second side. The apparatus further includes a waveguide antenna element positioned on the first side of the substrate assembly. The apparatus also includes a first reference ground plane positioned on the first side of the substrate assembly. The apparatus includes a microstrip line positioned within the substrate assembly and a stripline positioned within the substrate assembly and electrically connected to the microstrip line, the first reference ground plane overlapping the stripline. The apparatus further includes a second reference ground plane positioned on the second side of the substrate assembly and overlapping both the microstrip line and the stripline. The second reference ground plane is electrically shorted to the first reference ground plane. The apparatus also includes a stripline antenna element positioned on the second side of the substrate assembly and enclosed by the second reference ground plane.

In some embodiments, the apparatus includes a waveguide attached to the first side of the substrate assembly and enclosing the waveguide antenna element. In some embodiments, the waveguide is a circular waveguide. In some embodiments, the apparatus includes one or more substrates positioned between the waveguide antenna element and the microstrip line, where the microstrip line is proximity coupled to the waveguide antenna element. In some embodiments, the apparatus includes one or more substrates positioned between the stripline antenna element and the stripline, where the stripline is proximity coupled to the stripline antenna element. In some embodiments, the apparatus includes a slot defined within the waveguide antenna element. In some embodiments, the apparatus includes a slot defined within the stripline antenna element. In some embodiments, the apparatus includes one or more vias electrically shorting the first reference ground plane to the second reference ground plane. In some embodiments, the apparatus includes one or more electrical vias placed in proximity to the microstrip to stripline transition to perform impedance matching. In some embodiments, the waveguide antenna element and the first reference ground plane are positioned on a first substrate of the substrate assembly, the microstrip line and the stripline are positioned on a second substrate of the substrate assembly, and the second reference ground plane and the stripline antenna element are positioned on a third substrate of the substrate assembly.

In an embodiment, a method includes providing a waveguide antenna element and a first reference ground plane on a first substrate. The method further includes providing a microstrip line and a stripline on a second substrate, where the stripline is electrically connected to the microstrip line. The method also includes providing a second reference ground plane and a stripline antenna element on a third substrate. The method includes bonding the first substrate, second substrate, and third substrate together to form a substrate assembly having a first side and a second side, where the waveguide antenna element and the first reference ground plane are positioned on the first side, and where the second reference ground plane and the stripline antenna element are positioned on the second side.

In some embodiments, the method includes attaching a waveguide to the first side of the substrate assembly, the waveguide enclosing the waveguide antenna element. In some embodiments, the method includes positioning one or more additional substrates between the waveguide antenna element and the microstrip line, where the microstrip line is proximity coupled to the waveguide antenna element. In some embodiments, the method includes positioning one or more additional substrates between the stripline antenna element and the stripline, wherein the stripline is proximity coupled to the stripline antenna element. In some embodiments, the method includes providing one or more vias electrically shorting the first reference ground plane to the second reference ground plane. In some embodiments, the method includes providing one or more electrical vias placed in proximity to the microstrip to stripline transition to perform impedance matching. In some embodiments, providing the waveguide antenna element, the first reference ground plane, the microstrip line, the stripline, the second reference ground plane, and the stripline antenna element may include forming them using a subtractive process, an additive process, or a combination thereof. In some embodiments, the subtractive process includes laser etching, milling, wet etching, or a combination thereof, and the additive process includes printing, deposition, or a combination thereof.

In an embodiment, a method includes receiving a first time-varying electric field signal at a waveguide antenna element positioned on a first side of a substrate assembly, where the first time-varying electric field signal induces a current signal with circular behavior within the waveguide antenna element. The method further includes generating a current signal at a microstrip line via proximity coupling with to the waveguide antenna element. The method also includes generating a current signal at the stripline via electrically connecting to the microstrip line. The method includes generating a current signal at a stripline antenna element via proximity coupling to the stripline, where the current signal induces a second time-varying electric field signal.

Figure 1:
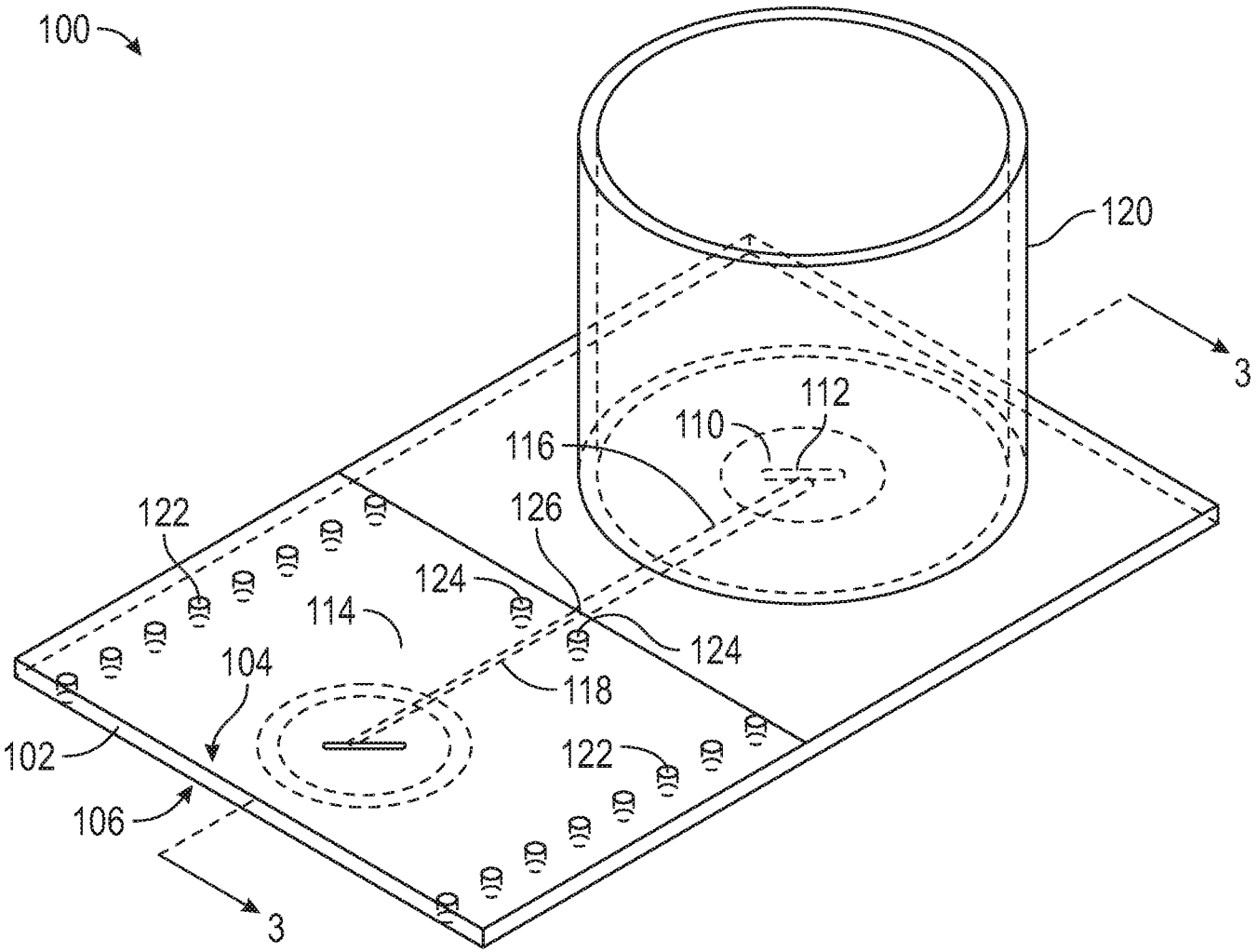
FIG. 1 is a schematic perspective view of an embodiment of a waveguide fed stripline antenna apparatus.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure as defined by the appended claims.

DETAILED DESCRIPTION

As used herein, the terms "top," "bottom," "first," and "second" can refer to relative directions or positions of features in the apparatus shown in the Figures. These terms, however, should be construed broadly to include apparatus having other orientations, such as inverted or inclined orientations where top/bottom, over/under, above/below, up/down, and left/right can be interchanged depending on the orientation.

Figure 2:
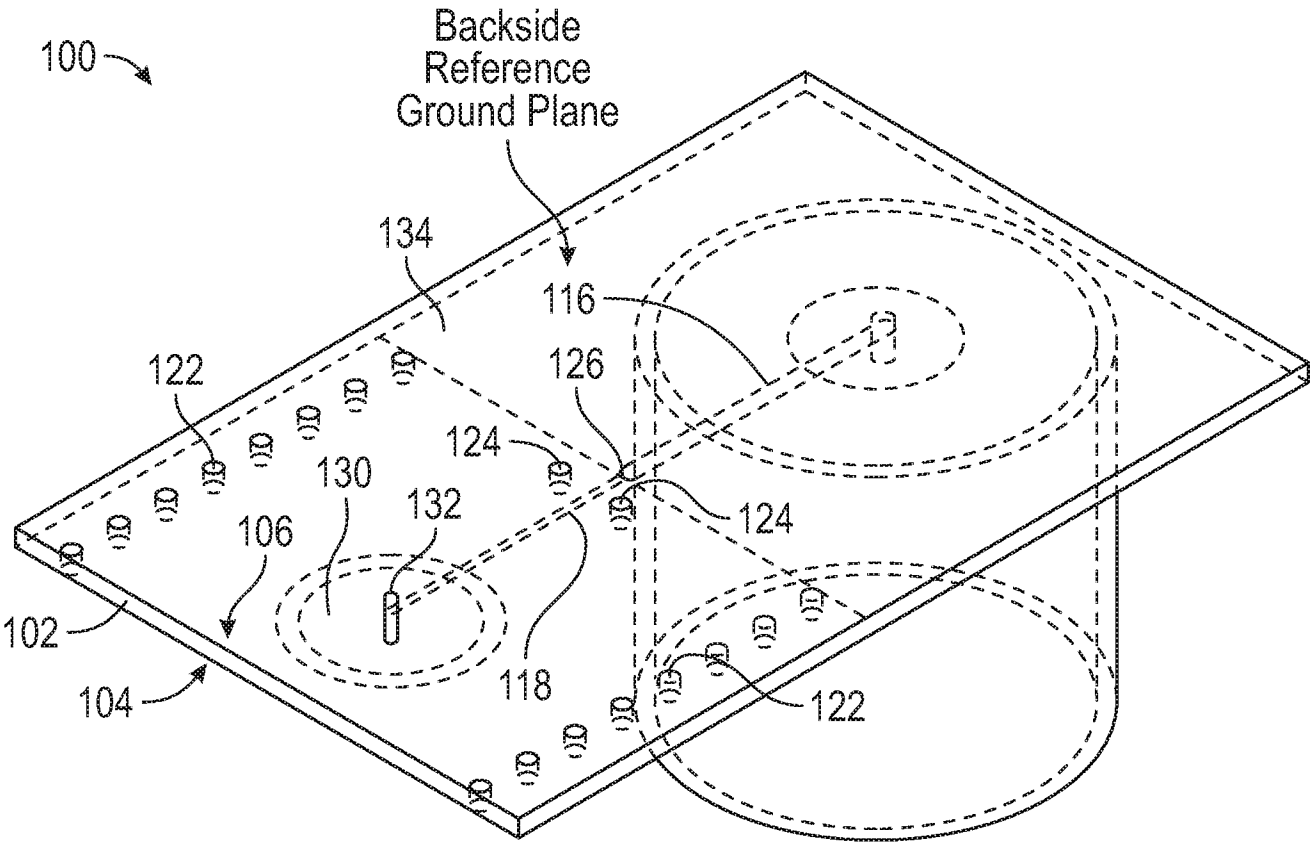
FIG. 2 is a schematic perspective view of an embodiment of a waveguide fed stripline antenna apparatus.

Referring to FIGS. 1 and 2, an embodiment of a waveguide fed stripline antenna apparatus 100 is depicted. The apparatus 100 may include a substrate assembly 102 having a first side 104 and a second side 106. Features positioned on the first side 104 of the substrate assembly 102 may be described with reference to FIG. 1. Features positioned on the second side 106 of the substrate assembly 102 may be described with reference to FIG. 2.

Referring to FIG. 1, on the first side 104 of the substrate assembly 102, the apparatus 100 may include a waveguide antenna element 110 and a first reference ground plane 114. The waveguide antenna element 110 may be a circular waveguide antenna element and may include a slot 112 defined therein. The slot 112 may enable a current with circular behavior to be induced within the waveguide antenna element 110 in response to reception of a signal at the waveguide antenna element 110. A waveguide 120 may be positioned on the first side 104 enclosing the waveguide antenna element 110. As used herein, "enclosing" means that the waveguide 120 surrounds the waveguide antenna element 110 along a plane as shown in FIG. 1. Although FIG. 1 depicts the waveguide 120 as a circular waveguide, other shapes, e.g., rectangular, are also possible.

The apparatus 100 may include a microstrip line 116 within the substrate assembly 102. The microstrip line 116 may be proximity coupled to the waveguide antenna element 110. In other words, the microstrip line 116 may be capacitively coupled with the waveguide antenna element 110 such that an electrical current within the waveguide antenna element 110 may induce an electrical current within the microstrip line 116.

Referring to FIG. 2, on the second side 106 of the substrate assembly 102, the apparatus 100 may include a second reference ground plane 134, which may be electrically shorted to the first reference ground plane 114 through one or more electrical vias 122. The second reference ground plane 134 may extend over the length 106 of the second side of the apparatus 100, which may be more easily seen in FIG. 3. The second reference ground plane 134 may overlap the microstrip line 116, and thereby provide reference ground functions in order to enable the microstrip line 116 to perform.

The first reference ground plane 114 and the second reference ground plane 134 may overlap along a portion of the substrate assembly 102. A stripline 118 may be positioned between the first reference ground plane 114 and the second reference ground plane 134 where they overlap. Thus, the first reference ground plane 114 and the second reference ground plane 134 may provide reference ground functions in order to enable the stripline 118 to perform.

The microstrip line 116 may be electrically connected to the stripline 118. A set of electrical vias 124 may be positioned proximate to a transition 126 between the microstrip line 116 and the stripline 118. The transition 126 may correspond to a region where the first reference ground plane 114 and the second reference ground plane 134 begin to overlap. The electrical vias 124 may be placed in proximity to and perform impedance matching functions between the microstrip line 116 and the stripline 118.

A stripline antenna element 130 may be positioned on the second side 106 of the substrate assembly 102. The stripline antenna element 130 may be a circular stripline antenna element and may include a slot 132 defined therein. The slot 132 may enable a current with circular behavior to be induced within the stripline antenna element 130 in response to a current at the stripline 118. The second reference ground plane 134 may enclose the stripline antenna element 130. By enclosing the stripline antenna element 130, the second reference ground plane 134 may capacitively couple with the stripline antenna element 130.

Figure 3:
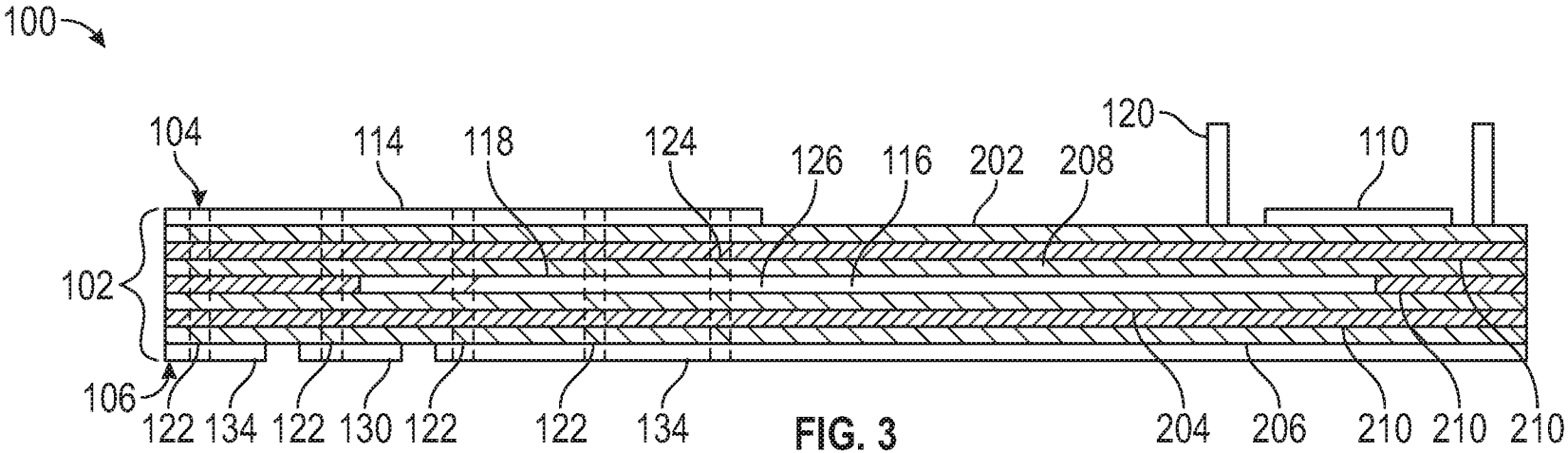
FIG. 3 is a schematic cross-sectional view of an embodiment of a waveguide fed stripline antenna apparatus.

Referring to FIG. 3, a cross-sectional view of the apparatus 100 is depicted. It should be noted that layer thicknesses and feature proportions may be adjusted in FIG. 3 as compared to FIGS. 1 and 2 for illustrative purposes.

As shown in FIG. 3, the substrate assembly 102 may include at least a first substrate 202, a second substrate 204, a third substrate 206, and an optional fourth substrate 208. The first side 104 of the substrate assembly 102 may correspond to the first substrate 202 while the second side 106 may correspond to the third substrate 206. The waveguide antenna element 110, the first reference ground plane 114, and the waveguide 120 may be positioned on the first substrate 202. The microstrip line 116 and the stripline 118 may be formed on the second substrate 204 within the substrate assembly 102. As illustrated in FIG. 3, the position of the transition 126 between the microstrip line 116 and the stripline 118 may correspond to where the first reference ground plane 114 and the second reference ground plane 134 begin to overlap.

The second reference ground plane 134 and the stripline antenna element 130 may be positioned on the third substrate 206. The optional fourth substrate 208 may be for spacing purposes. Although not shown, additional substrates may also be included for spacing purposes. The electrical vias 122 may pass through each of the substrates 202-208 to electrically short the first reference ground plane 114 to the the second reference ground plane 134. The substrates 202-208 may be joined together by one or more joining layers 210 (e.g., adhesive layers).

Figure 4:
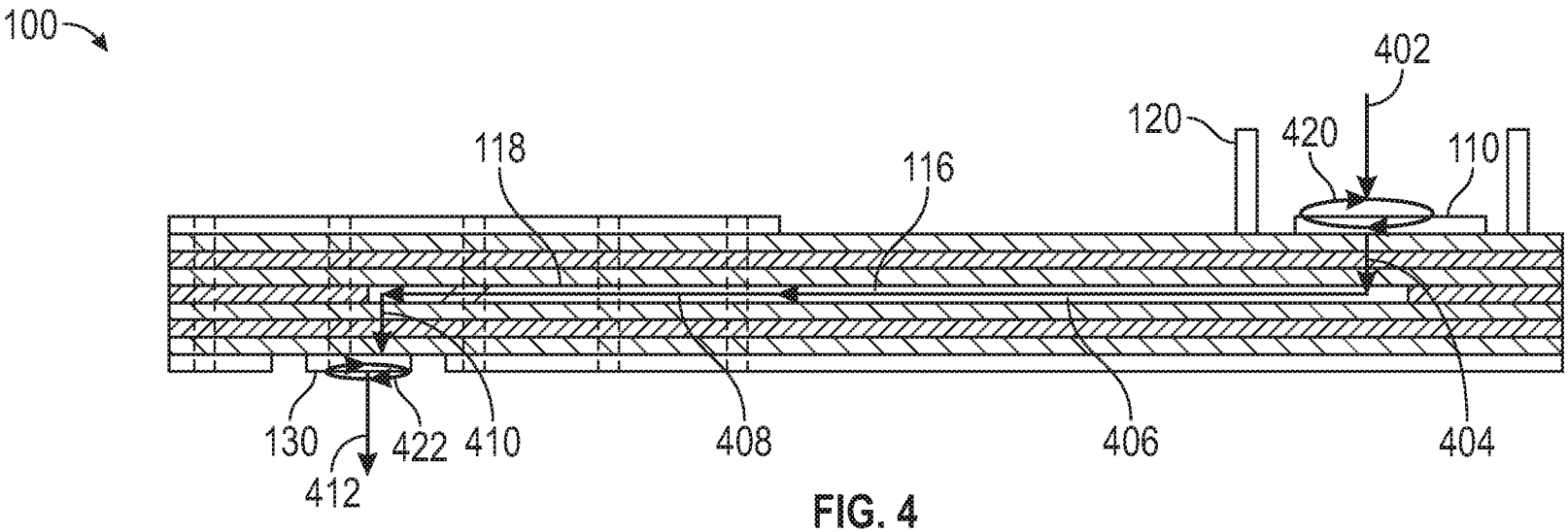
FIG. 4 is a schematic cross-sectional view of an embodiment of a waveguide fed stripline antenna apparatus showing a first time-varying electric field signal path through the apparatus.

Operation of the apparatus 100 is described with reference to FIGS. 4 and 5. Referring to FIG. 4, a first time-varying electric field 402 may be incident to the waveguide antenna element 110 from the waveguide 120. The first time-vary electric field 402 may induce a current signal 420 with circular behavior within the waveguide antenna element 110. In response to the current signal 420, a capacitive signal 404 may be induced and may generate a current signal 406 at the microstrip line 116. The linear current signal 406 may be received at the stripline 118 and may continue as a stripline feed signal 408 within the stripline 118. The stripline feed signal 408 may induce a capacitive signal 410 which may generate a current signal 422 with circular behavior at the stripline antenna element 130. The current signal 422 may then induces a second time-varying electric field 412 which may be used for signal transmission.

Figure 5:
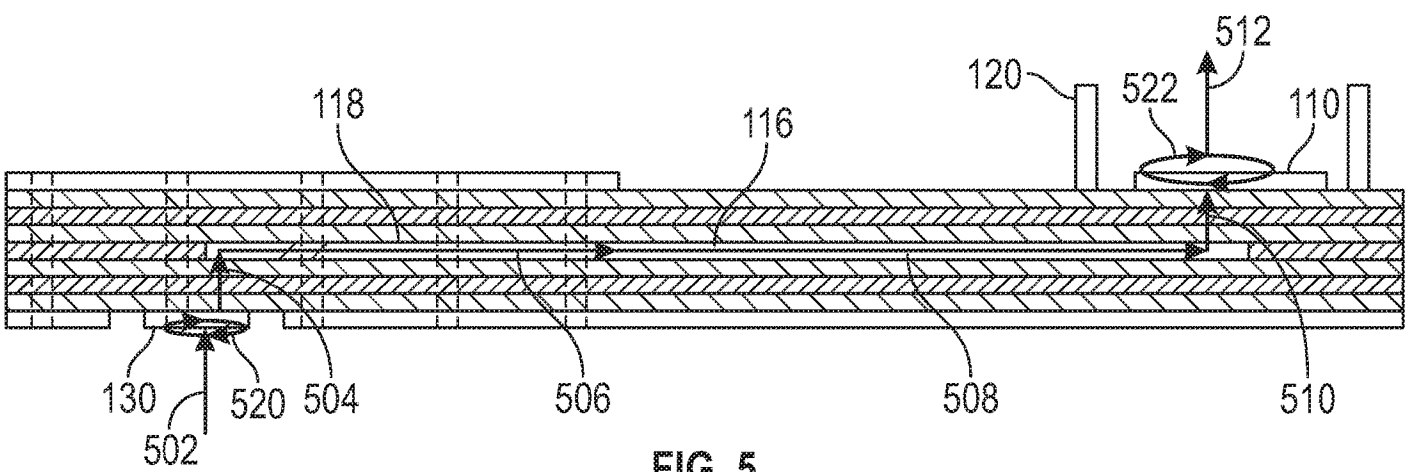
FIG. 5 is a schematic cross-sectional view of an embodiment of a waveguide fed stripline antenna apparatus showing a second time-varying electric field signal path through the apparatus.

Referring to FIG. 5, a first time-varying electric field 502 may be received at the stripline antenna element 130. The first time-varying electric field 502 may induce a current signal 520 with circular behavior within the stripline antenna element 130. In response to the current signal 520 a capacitive signal 504 may be induced and may generate a current signal 506 at the stripline 118. The current signal 506 may be received at the microstrip line 116 and may continue as a waveguide feed signal 508. The waveguide feed signal 508 may induce a capacitive signal 510 which may generate a current signal 522 with circular behavior at the waveguide antenna element 110. The current signal 522 may induce a second time-varying electric field 512 for propagation within the waveguide 120.

A benefit of the apparatus 100 is that the apparatus 100 may have a reduced size, weight, and cost in comparison to existing waveguide-to-coax adapters and further coax-to-stripline adapters. Further, the substrate assembly 102 may exhibit a lower profile as compared to existing adapters. In some embodiments, the apparatus 100 may operate when the first time-varying electric fields 402, 502 have frequencies of about 20 GHz. Other advantages may exist.

Figure 6A:
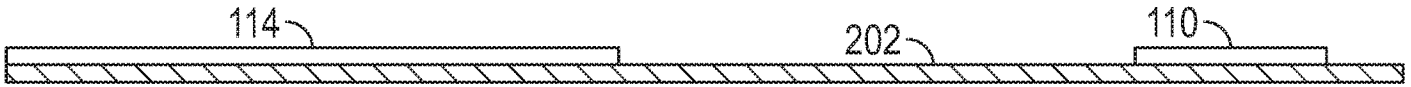
FIG. 6A is a schematic cross-sectional view of an example of a first substrate including an antenna element and a ground plane.
Figure 6B:
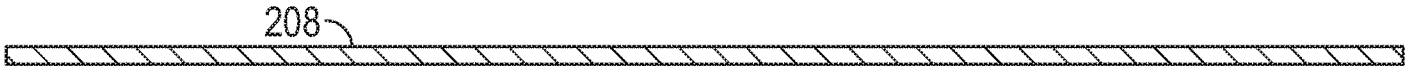
FIG. 6B is a schematic cross-sectional view of an example of an optional fourth substrate.
Figure 6C:
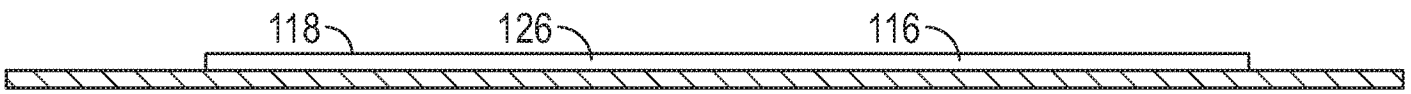
FIG. 6C is a schematic cross-sectional view of an example of a second substrate including a microstrip line and a stripline.
Figure 6D:
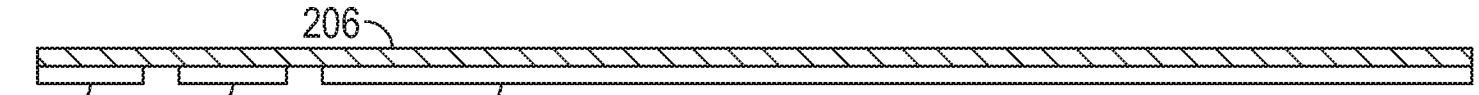
FIG. 6D is a schematic cross-sectional view of an example of a third substrate including an antenna element and a ground plane.

FIG. 6A is a schematic cross-sectional view of an embodiment of a first substrate 202 having a waveguide antenna element 110 and first reference ground plane 114 positioned thereon. FIG. 6B is a schematic cross-sectional view of an embodiment of a fourth substrate 208. FIG. 6C is a schematic cross-sectional view of an embodiment of a second substrate 204 with a microstrip line 116 and stripline 118 positioned thereon, and with the transition 126 therebetween. FIG. 6D is a schematic cross-sectional view of an embodiment of a third substrate 206 having a stripline antenna element 130 and second reference ground plane 134 positioned thereon.

Figure 6E:
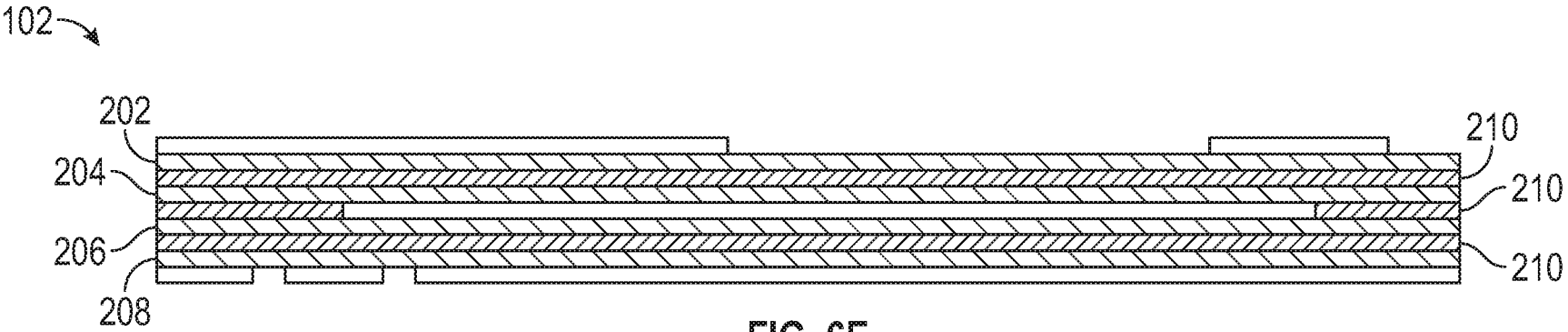
FIG. 6E is a schematic cross-sectional view of an example of a first substrate, second substrate, third substrate, and a fourth substrate bonded together to form a substrate assembly.

FIG. 6E is a schematic cross-sectional view of an embodiment of a substrate assembly 102 formed by bonding together the first substrate 202, the second substrate 204, the third substrate 206, and the fourth substrate 208. The substrates 202-208 may be bonded together via joining layers 210, which may include adhesive, bonding material, or laminated material as would be appreciated by one of ordinary skill in the art having the benefit of this disclosure. More or fewer layers may be used to form the substrate assembly 102 as would be appreciated by one of ordinary skill in the art having the benefit of this disclosure. Further, the formation of the substrates 202-208 may be performed through additive processes, subtractive processes, or combinations thereof.

Figure 6F:
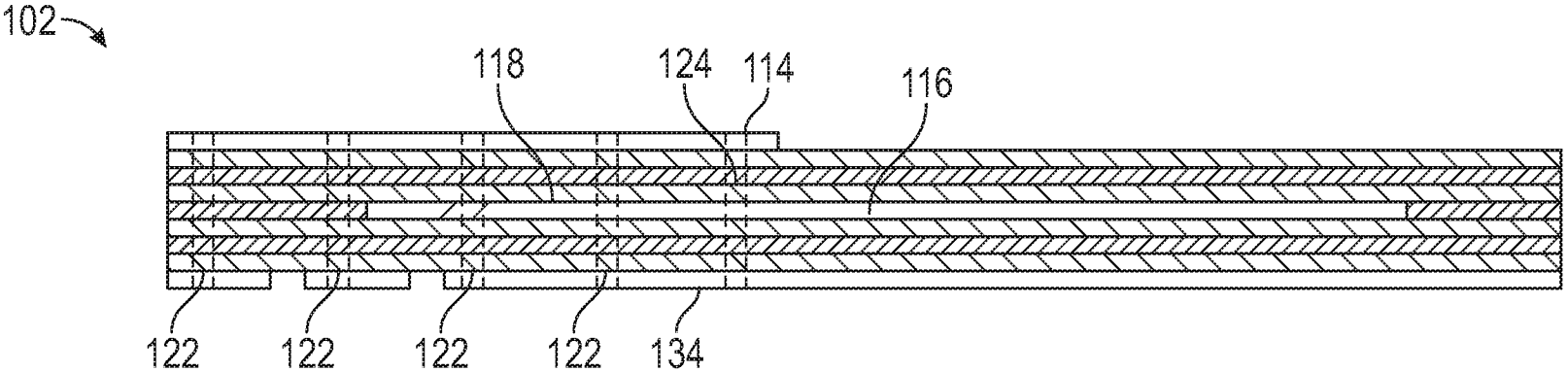
FIG. 6F is a schematic cross-sectional view of an embodiment of a waveguide fed stripline antenna.

FIG. 6F is a schematic cross-sectional view of an embodiment of a substrate assembly 102 having a first set of electrical vias 122 and a second set of electrical vias 124 formed therein. The first set of electrical vias 122 may electrically short the first reference ground plane 114 to the second reference ground plane 134. The stripline 118 may be positioned between the first reference ground plane 114 and the second reference ground plane 134. The second set of electrical vias 124 may electrically short the first reference ground plane 114 to the second reference ground plane 134 and may be positioned in proximity to the stripline 118 to perform impedance matching functions between the microstrip line 116 and the stripline 118.

Figure 6G:
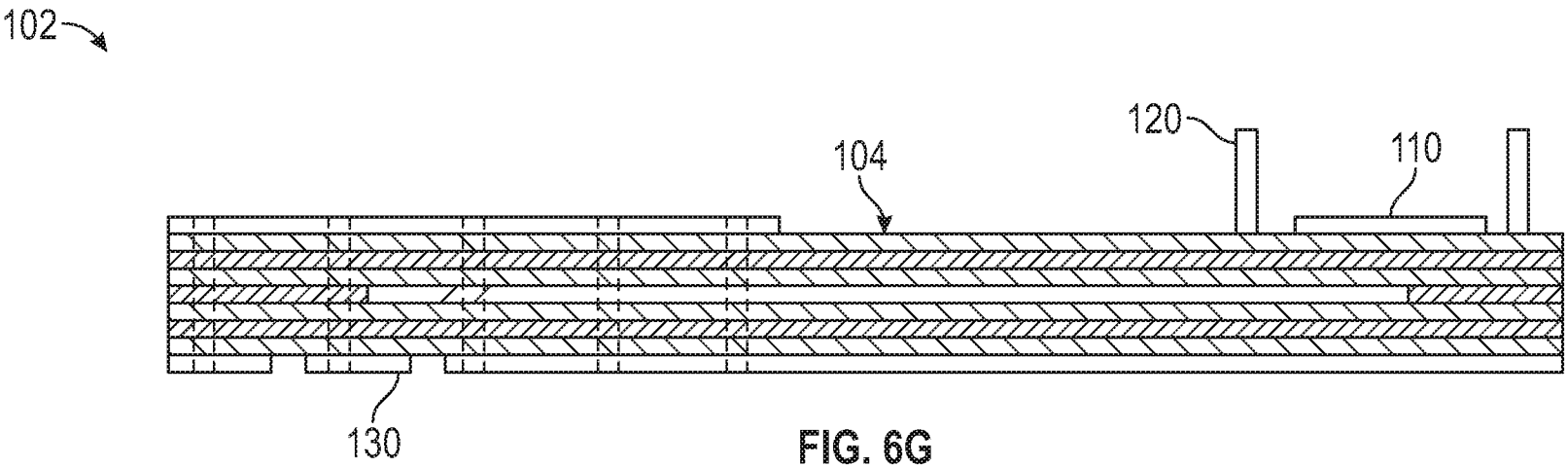
FIG. 6G is a schematic cross-sectional view of an embodiment of a waveguide fed stripline antenna.

FIG. 6G is a schematic cross-sectional view of an embodiment of a waveguide fed stripline antenna apparatus 100. As shown in FIG. 6G, after the substrate assembly 102 is formed, a waveguide 120 may be attached to the first side 104 and may encompass the waveguide antenna element 110. As discussed herein, the apparatus 100 may be used to transmit signals to the stripline antenna element 130 using the waveguide 120.

Figure 7:
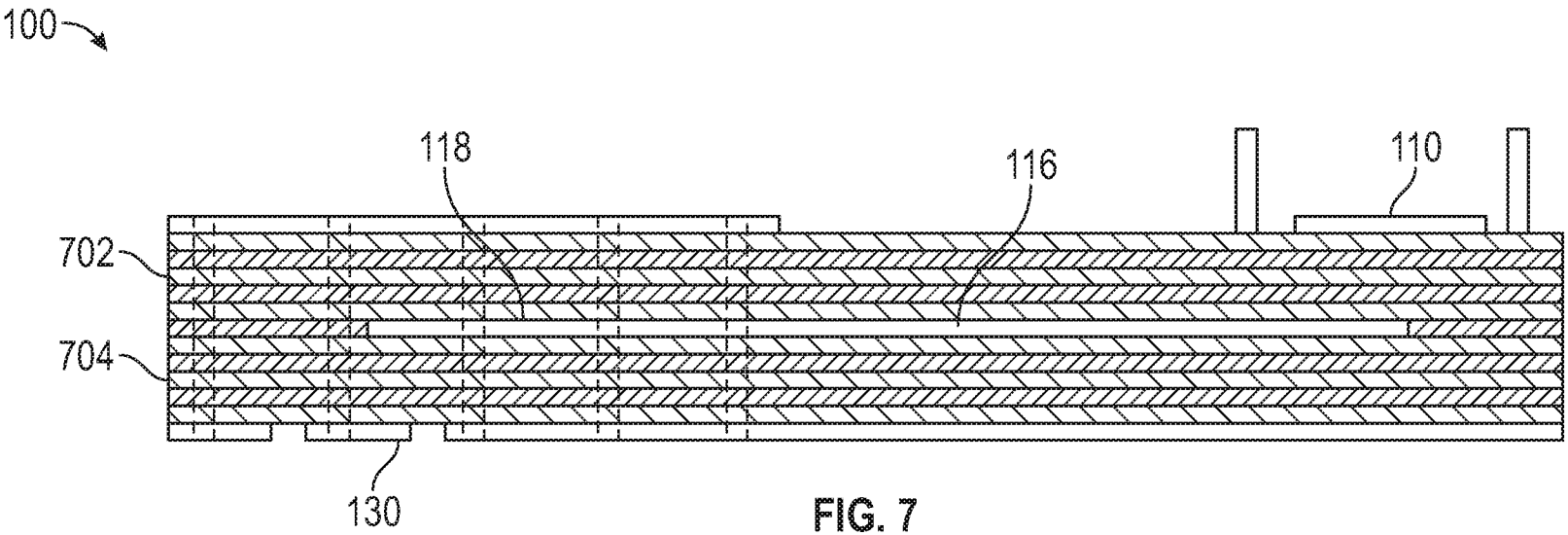
FIG. 7 is a schematic cross-sectional view of an embodiment of a waveguide fed stripline antenna.

Referring to FIG. 7, a schematic cross-section view of an embodiment of a waveguide fed stripline antenna apparatus 100 is depicted. In order to tune a proximity coupling between the waveguide antenna element 110 and the microstrip line 116, one or more additional substrates 702 may be positioned therebetween. Likewise, in order to tune a proximity coupling between the stripline antenna element 130 and the stripline 118, one or more additional substrates 704 may be positioned therebetween.

Figure 8:
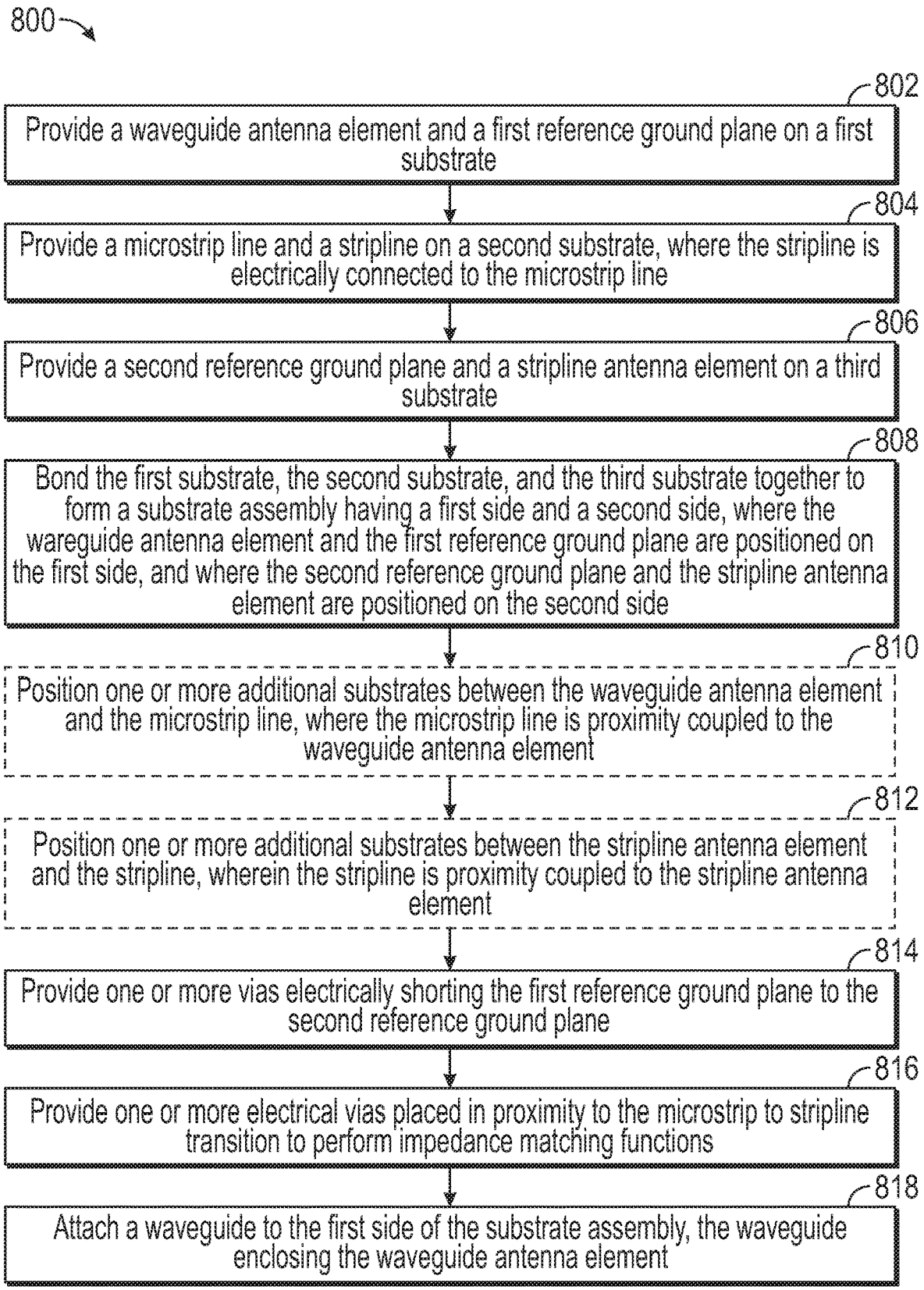
FIG. 8 is a flow diagram depicting an embodiment of a method for forming a waveguide fed stripline antenna apparatus

FIG. 8 is a flow chart of an embodiment of a method 800 of the present disclosure. The method 800 may include providing a waveguide antenna element and a first reference ground plane on a first substrate, at 802. For example, the waveguide antenna element 110 and the first reference ground plane 114 may be formed on the first substrate 202.

The method 800 may further include providing a microstrip line and a stripline on a second substrate, where the stripline is electrically connected to the microstrip line, at 804. For example, the microstrip line 116 and the stripline 118 may be formed on the second substrate 204.

The method 800 may also include providing a second reference ground plane and a stripline antenna element on a third substrate, at 806. For example, the second reference ground plane 134 and a stripline antenna element 130 may be formed on the third substrate 206.

The method 800 may include bonding the first substrate, the second substrate, and the third substrate together to form a substrate assembly having a first side and a second side, where the waveguide antenna element and the first reference ground plane are positioned on the first side, and where the second reference ground plane and the stripline antenna element are positioned on the second side, at 808. For example, the first substrate 202, the second substrate 204, and the third substrate 206 may be bonded together to form the substrate assembly 102.

The method 800 may also optionally include positioning one or more additional substrates between the waveguide antenna element and the microstrip line, where the microstrip line is proximity coupled to the waveguide antenna element, at 810. For example, the one or more additional substrates 702 may be positioned between the waveguide antenna element 110 and the microstrip line 116.

The method 800 may also optionally include positioning one or more additional substrates between the stripline antenna element and the stripline, where the stripline is proximity coupled to the stripline antenna element, at 812. For example, the one or more additional substrates 704 may be positioned between the stripline antenna element 130 and the stripline 118.

The method 800 may include providing one or more vias electrically shorting the first reference ground plane to the second reference ground plane, at 814. For example, the one or more vias 122 may be formed and may electrically short the first reference ground plane 114 to the second reference ground plane 134.

The method 800 may further include attaching a waveguide to the first side of the substrate assembly, the waveguide enclosing the waveguide antenna element, at 816. For example, the waveguide 120 may be attached to the first side 104 of the substrate assembly 102.

The method 800 may further include providing one or more electrical vias placed in proximity to the microstrip to stripline transition to perform impedance matching functions between the microstrip line and the stripline, at 818. For example, the one or more vias 124 may be formed and may be electrically short the first reference ground plane 114 to the second reference ground plane 134.

In some embodiments of the method 800, providing the waveguide antenna element, the first reference ground plane, the microstrip line, the stripline, the second reference ground plane, and the stripline antenna element is performed using a subtractive process, an additive process, or a combination thereof. Further, the subtractive process may include laser etching, milling, wet etching, or a combination thereof, and the additive process may include printing, deposition, or a combination thereof.

Figure 9:
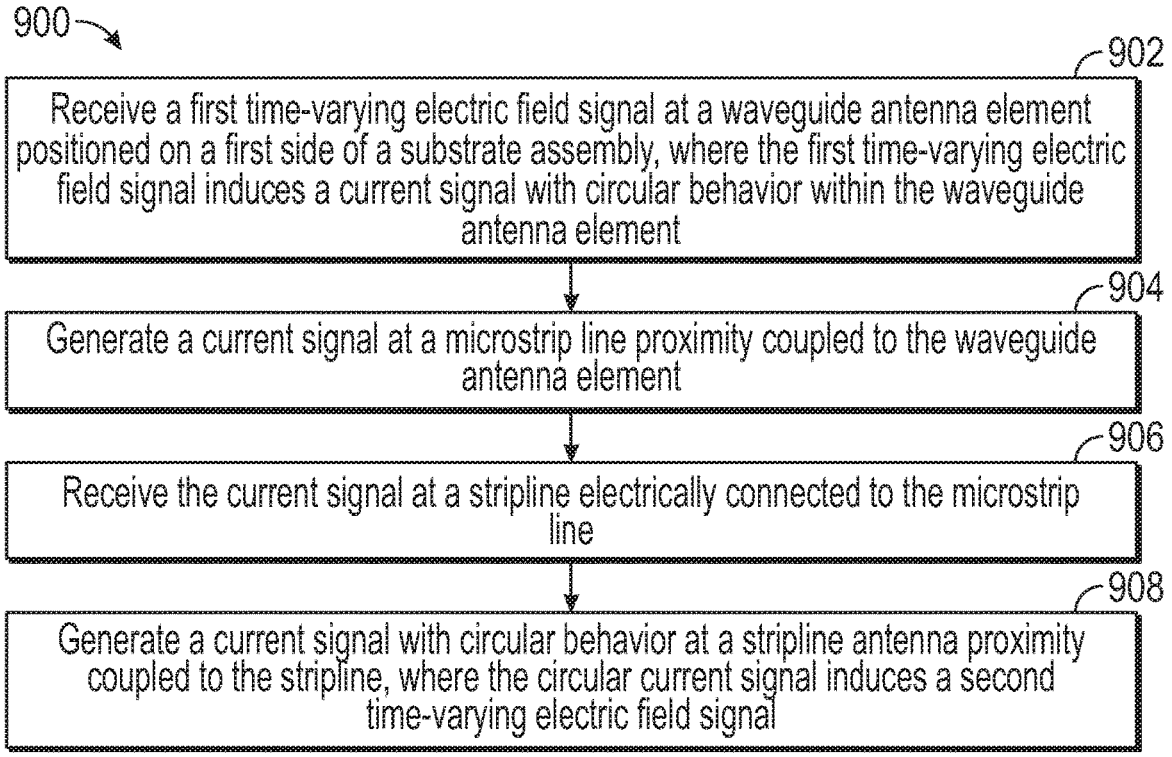
FIG. 9 is a flow diagram depicting an embodiment of a method for transmitting a time-varying electromagnetic signal at a stripline antenna element using a waveguide.

Referring to FIG. 9, an embodiment of a method 900 for transmitting signals to a stripline antenna element using a waveguide is depicted. The method 900 may include receiving a first time-varying electric field at a waveguide antenna element positioned on a first side of a substrate assembly, where the first time-varying electric field induces a current signal with circular behavior within the waveguide antenna element, at 902. For example, the first time-varying electric field 402 may be received at the waveguide antenna element 110 and may induce the current signal 420 with circular behavior within the waveguide antenna element 110.

The method 900 may further include generating a current signal at a microstrip line proximity coupled to the waveguide antenna element, at 904. For example, the current signal 406 may be generated at the microstrip line 116, which may be proximity coupled to the waveguide antenna element 110.

The method 900 may also include receiving the current signal at a stripline electrically connected to the microstrip line, at 906. For example, the current signal 406 may be received at the stripline 118 electrically connected to the microstrip line 116.

The method 900 may include generating a current signal with circular behavior at a stripline antenna element proximity coupled to the stripline, where the current signal induces a second time-varying electric field, at 908. For example, the current signal 422 may be generated at the stripline antenna element 130, which may be proximity coupled to the stripline 118, and the current signal 422 may induce the second time-varying electric field 412. Thus, the method 900 may be used for transmitting signals to the stripline antenna element 130 with the waveguide 120.

Figure 10:
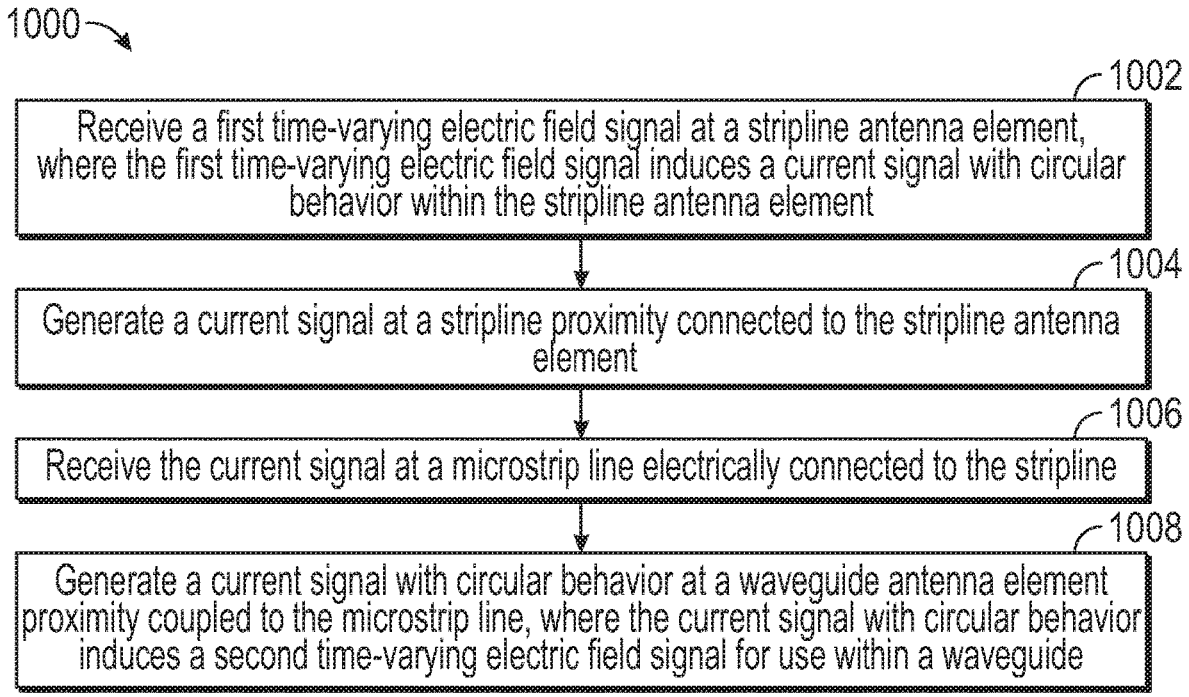
FIG. 10 is a flow diagram depicting an embodiment of a method for receiving a time-varying electromagnetic signal at a stripline antenna element.

FIG. 10 is a flow diagram depicting an embodiment of a method 1000 for receiving a signal at a stripline antenna element. The method 1000 may include receiving a first time-varying electric field at a stripline antenna element, where the first time-varying electric field induces a current signal with circular behavior within the stripline antenna element, at 1002. For example, the first time-varying electric field 502 may be received at the stripline antenna element 130, and the first time-varying electric field 502 may induce a current signal 420 within the stripline antenna element 130.

The method 1000 may further include generating a current signal at a stripline proximity coupled to the stripline antenna element, at 1004. For example, the current signal 506 may be generated at the stripline 118, which may be proximity coupled to the stripline antenna element 130.

The method 1000 may also include receiving the current signal at a microstrip line electrically connected to the stripline, at 1006. For example, the current signal 506 may be received at the microstrip line 116, which may be electrically connected to the stripline 118.

The method 1000 may include generating a current signal with circular behavior at a waveguide antenna element proximity coupled to the microstrip line, where the current signal induces a second time-varying electric field for use within a waveguide, at 1008. For example, the current signal 522 may be generated at the waveguide antenna element 110, which may be proximity coupled to the microstrip line 116, and the current signal 522 may induce the second time-varying electric field 512 for use within the waveguide 120.

Although this disclosure has been described in terms of certain embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof

What is claimed is:

1. An apparatus comprising:

a substrate assembly having a first side and a second side;

a waveguide antenna element positioned on the first side of the substrate assembly;

a first reference ground plane positioned on the first side of the substrate assembly;

a microstrip line positioned within the substrate assembly;

a stripline positioned within the substrate assembly and electrically connected to the microstrip line, the first reference ground plane overlapping the stripline;

a second reference ground plane positioned on the second side of the substrate assembly and overlapping both the microstrip line and the stripline; and a stripline antenna element positioned on the second side of the substrate assembly and enclosed by the second reference ground plane.

2. The apparatus of claim 1, further comprising:

a waveguide attached to the first side of the substrate assembly and enclosing the waveguide antenna element.

3. The apparatus of claim 2, wherein the waveguide is a circular waveguide.

4. The apparatus of claim 1, further comprising:

one or more substrates positioned between the waveguide antenna element and the microstrip line, wherein the microstrip line is proximity coupled to the waveguide antenna element.

5. The apparatus of claim 1, further comprising:

one or more substrates positioned between the stripline antenna element and the stripline, wherein the stripline is proximity coupled to the stripline antenna element.

6. The apparatus of claim 1, further comprising:

a slot defined within the waveguide antenna element.

7. The apparatus of claim 1, further comprising:

a slot defined within the stripline antenna element.

8. The apparatus of claim 1, further comprising:

one or more vias electrically shorting the first reference ground plane to the second reference ground plane.

9. The apparatus of claim 1, further comprising:

one or more vias electrically shorting the first reference ground plane to the second reference ground plane and configured to perform impedance matching at a transition between the microstrip line and the stripline.

10. The apparatus of claim 1, wherein the waveguide antenna element and the first reference ground plane are positioned on a first substrate of the substrate assembly, wherein the microstrip line and the stripline are positioned on a second substrate of the substrate assembly, and wherein the second reference ground plane and the stripline antenna element are positioned on a third substrate of the substrate assembly.

11. A method comprising:

providing a waveguide antenna element and a first reference ground plane on a first substrate;

providing a microstrip line and a stripline on a second substrate, wherein the stripline is electrically connected to the microstrip line;

providing a second reference ground plane and a stripline antenna element on a third substrate; and bonding the first substrate, the second substrate, and the third substrate together to form a substrate assembly having a first side and a second side, wherein the waveguide antenna element and the first reference ground plane are positioned on the first side, and wherein the second reference ground plane and the stripline antenna element are positioned on the second side.

12. The method of claim 11, further comprising:

attaching a waveguide to the first side of the substrate assembly, the waveguide enclosing the waveguide antenna element.

13. The method of claim 11, further comprising:

positioning one or more additional substrates between the waveguide antenna element and the microstrip line, wherein the microstrip line is proximity coupled to the waveguide antenna element.

14. The method of claim 11, further comprising:

positioning one or more additional substrates between the stripline antenna element and the stripline, wherein the stripline is proximity coupled to the stripline antenna element.

15. The method of claim 11, further comprising:

providing one or more vias electrically shorting the first reference ground plane to the second reference ground plane.

16. The method of claim 11, further comprising:

providing one or more vias electrically shorting the first reference ground plane to the second reference ground plane and configured to perform impedance matching at a transition between the microstrip line and the stripline.

17. The method of claim 11, wherein providing the waveguide antenna element, the first reference ground plane, the microstrip line, the stripline, the second reference ground plane, and the stripline antenna element is performed using a subtractive process, an additive process, or a combination thereof.

18. The method of claim 17, wherein the subtractive process includes laser etching, milling, wet etching, or a combination thereof, and wherein the additive process includes printing, deposition, or a combination thereof.

19. A method comprising:

receiving a first time-varying electric field at a waveguide antenna element positioned on a first side of a substrate assembly, wherein the first time-varying electric field induces a first current signal with circular behavior within the waveguide antenna element;

generating a current signal at a microstrip line proximity coupled to the waveguide antenna element;

receiving the current signal at a stripline electrically connected to the microstrip line; and generating a second current signal with circular behavior at a stripline antenna element proximity coupled to the stripline, wherein the second current signal induces a second time-varying electric field.

20. The method of claim 19, wherein the first time-varying electric field has a frequency of about 20 GHz.

* * * * *